United States Patent [19]

Johnson

[11] 4,241,679

[45] Dec. 30, 1980

[54] INERTIAL THREAD SNUBBING DEVICE FOR A SEWING MACHINE

[75] Inventor: Ralph E. Johnson, Convent Station, N.J.

[73] Assignee: The Singer Company, Stamford, Conn.

[21] Appl. No.: 128,206

[22] Filed: Mar. 7, 1980

[51] Int. Cl.[3] ..... D05B 47/04

[52] U.S. Cl. ..... 112/255

[58] Field of Search ..... 112/255, 254, 253, 242, 112/243; 226/195; 242/153, 154

[56] References Cited

U.S. PATENT DOCUMENTS

| | | | |
|---|---|---|---|
| 331,026 | 11/1885 | Bigelow | 112/200 |
| 765,239 | 7/1904 | Hadley | 112/255 X |
| 908,434 | 12/1908 | Woodward | 112/242 |
| 1,041,597 | 10/1912 | Corey | 112/255 |
| 1,312,799 | 8/1919 | Moffatt et al. | 112/255 |
| 1,460,177 | 6/1923 | Ringe et al. | 112/248 |
| 3,496,895 | 2/1970 | Ketterer | 112/255 |

*Primary Examiner*—H. Hampton Hunter

*Attorney, Agent, or Firm*—William V. Ebs; Robert E. Smith; Edward L. Bell

[57] ABSTRACT

A thread snubbing device for a sewing machine is provided with a cage which attaches to a needle clamp, and with a shoe of predetermined mass which is loosely confined by the cage wherein it is caused by inertia and engagement with the cage to be moved against a length of needle thread between the shoe and clamp to apply a snubbing action thereto during loop seizure and loop formation.

7 Claims, 10 Drawing Figures

Fig.1
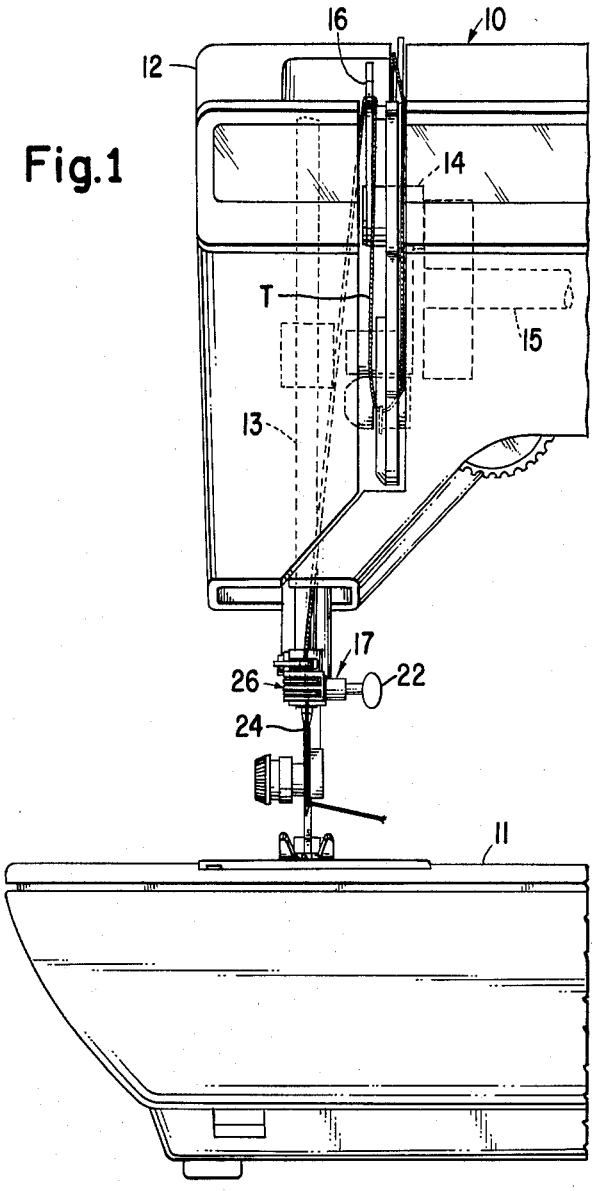
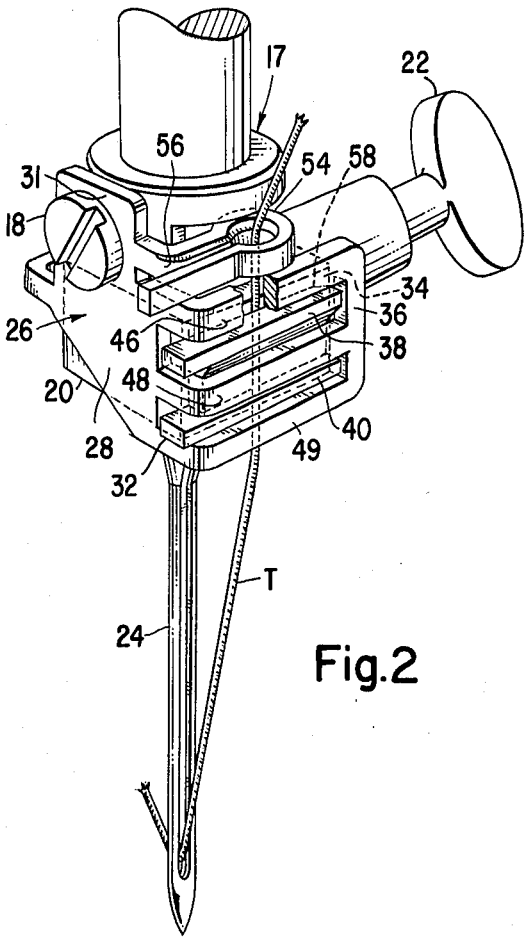
Fig.2
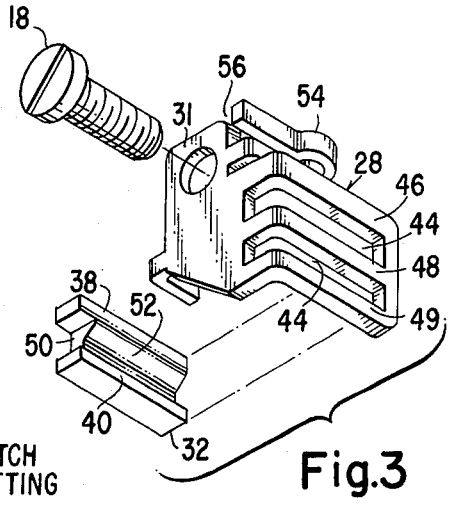
Fig.3
Fig.6
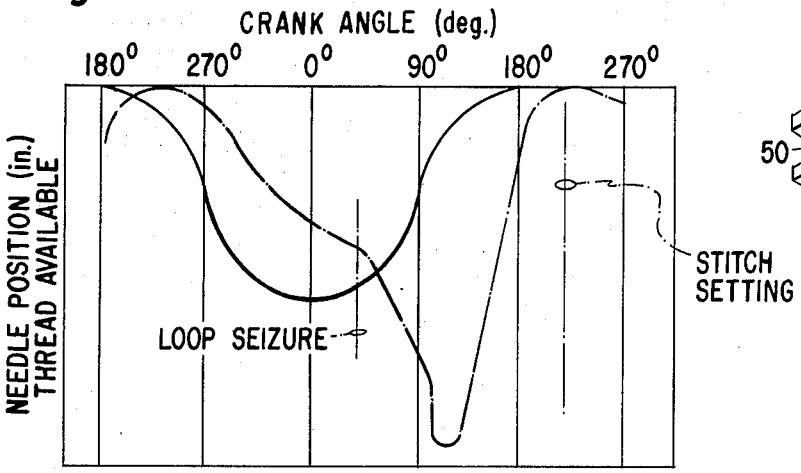

Fig.4
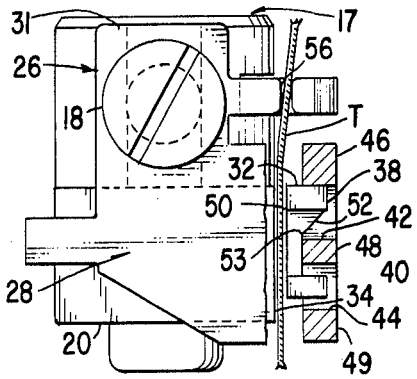
Fig.5
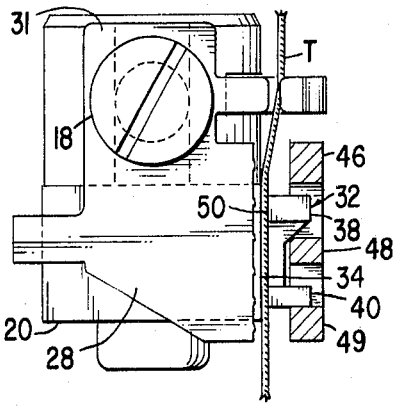
Fig.7
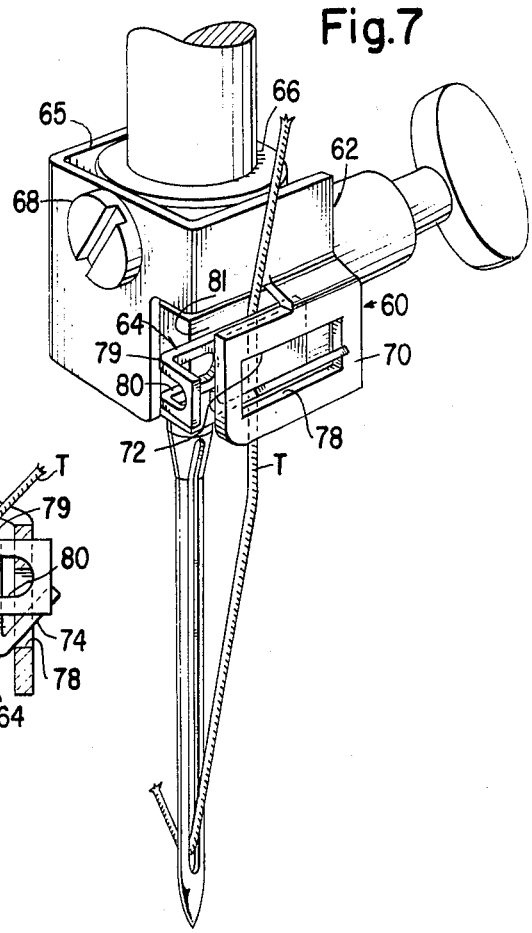
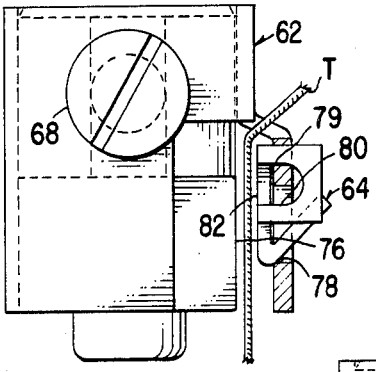
Fig.8
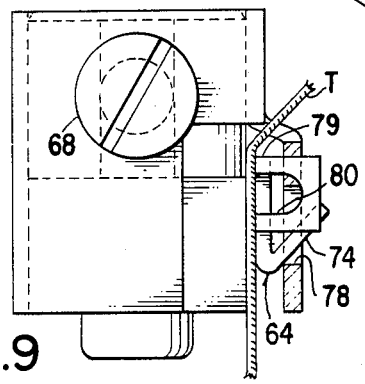
Fig.9
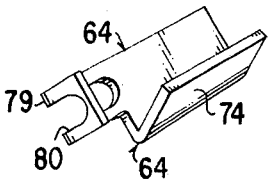
Fig.10

INERTIAL THREAD SNUBBING DEVICE FOR A SEWING MACHINE

BACKGROUND OF THE INVENTION

1. Field of the Invention

The invention relates to needle thread snubbing devices for use on sewing machines.

2. Description of the Prior Art

It is well known to dispose a needle thread snubbing device between a sewing machine needle and a needle thread take-up for controlling the size of a needle thread loop presented to the loop taker of a lockstitch sewing machine. However, many of the prior needle thread snubbing devices have had a drawback in that they snubbed needle thread not only during loop presentation but also during stitch setting thereby requiring thread tensioning devices to be set at correspondingly higher values which increased the possibility of thread breakage. One exception is the automatically operable inertial thread snubbing device of U.S. Pat. No. 3,496,895 of S. J. Ketterer issued Feb. 24, 1970 and assigned to The Singer Company. Such inertial snubbing device, however, while effective to apply a snubbing action during loop presentation and remove or greatly reduce the snubbing action during stitch setting provided for point contact only at the snubber with the needle thread and sometimes resulted in the thread being pinched in the device. The device of the patent was also difficult to thread. Various other previously proposed needle thread snubbing devices are driven through linkage arrangements by the operating mechanism of a machine to effect snubbing when necessary. However, such thread snubbing devices and associated mechanism are complex and costly to manufacture.

SUMMARY OF THE INVENTION

In accordance with this invention there is provided an inertially controlled snubbing device operable to establish line contact with the needle thread of a sewing machine and so effect a snubbing action. Such device includes a cage which attaches to the needle clamp of a machine and a shoe of predetermined mass which is loosely held next to the clamp by the cage. Needle thread passes between flat opposing surfaces of the shoe and clamp. The inertia of the shoe and mutual engagement of the shoe and cage along an inclined surface on one causes the shoe to be moved to squeeze the needle thread between the opposing flat surfaces on the shoe and clamp during upward acceleration and downward deceleration of the needle bar.

DESCRIPTION OF THE DRAWINGS

FIG. 1 is a front elevational view of a portion of a sewing machine having a needle thread snubbing device according to the invention affixed thereto;

FIG. 2 is an enlarged perspective view of the needle thread snubbing device of FIG. 1 and needle clamp to which it is affixed;

FIG. 3 is an enlarged exploded perspective view of the thread snubbing device;

FIG. 4 is an end view of the snubbing device which is shown partially in section and with thread released therein;

FIG. 5 is a view similar to FIG. 4 showing the thread snubbed;

FIG. 6 is a graph showing a plot of the endwise position of needle reciprocation together with a plot of the thread which is made available by the take-up of the machine of FIG. 1;

FIG. 7 is an enlarged perspective view showing a modified form of needle thread snubbing device according to the invention on a needle clamp;

FIG. 8 is an end view of the snubbing device of FIG. 7 shown partially in section and with thread released therein; and, FIG. 9 is a view similar to FIG. 8 showing the thread snubbed;

FIG. 10 is a perspective view showing a portion of the device of FIGS. 7, 8 and 9.

DESCRIPTION OF THE PREFERRED EMBODIMENT

Referring to FIG. 1 of the drawings, reference character 10 designates a portion of a sewing machine including a work supporting bed 11 and a bracket arm 12 which carries a reciprocable needle bar 13. The needle bar is operable by a crank 14 which connects with a driving arm shaft 15. Also actuated by the crank is a take-up lever 16. A needle clamp 17 is secured to the lower extremity of the needle bar 14 in suitable fashion as by a screw 18 extending through a collar 20 formed in the clamp and into the needle bar. A thumb screw 22 serves to secure a thread carrying needle 24 to the needle clamp.

In the operation of the sewing machine of FIG. 1, it is the function of the thread carrying needle 24 to carry loops of needle thread through a work fabric and to present such loops to stitch forming instrumentalities (not shown) in the bed for concatenation into stitches. The take-up lever 16 pays out slack to accommodate reciprocation of the needle and manipulation of needle thread by the stitch forming instrumentalities beneath the bed and to draw up slack thread into a stitch in the work fabric.

The machine is provided with a thread snubbing device in accordance with the invention to control the downward flow of slackened thread T to the needle during the stitch forming process so that excess slack thread doesn't pile up under the needle before the needle penetrates the work and excess thread doesn't occur prior to seizure and manipulation of the thread by the stitch forming instrumentalities in the bed as the needle begins to rise. Such thread snubbing devices may, for example, take the form shown in FIGS. 1 through 5 or the form shown in FIGS. 7 through 10.

In FIGS. 1 through 5, the snubbing device, designated by reference character 26, is shown as including a cage 28 which attaches as by the screw 18 extending through a flange 31 of the cage and the needle clamp 17. Such snubbing device 26 includes a shoe 32 which is loosely held opposite a front flat surface 34 on the needle clamp by a ribbed portion 36 of the cage. As shown, the shoe 32 includes parallel lands 38 and 40 which register with slots 42 and 44, respectively, defined by ribs 46, 48 and 49. The rear of the shoe is formed with a flat surface 50 which faces the flat surface 34 on the needle clamp, and the underside of land 38 is formed with an inclined surface 52 to engage the upper inside edge 53 of rib 48. The cage 28 includes a thread guide 54 with an access opening 56 at the left side of the snubbing device as viewed in FIGS. 2 and 3 for thread T. The device is threaded by introducing thread from take-up lever 16 into the thread guide 54 by way of side thread accessible opening 56, leading the thread over rib 46 to the right side of the guide and then pulling the thread back to the left between the flat surfaces 34 and 50 on the cage and shoe, respectively. The right end of land 38 is rounded at 58 to facilitate movement of the thread over the shoe.

During reciprocation of the needle bar, shoe 32 is caused by reason of its inertial mass to move upwardly or downwardly in the cage depending upon the direction in which the needle bar is moving and whether it is accelerating or decelerating. Upward acceleration and downward deceleration of the needle bar results in downward movement of the shoe relative to the cage. As the shoe moves downwardly in the cage, it is cammed toward the needle clamp 17 by the engagement of the edge 53 or rib 48 on cage 28 with the inclined surface 52, and pressure is applied to the thread T by the flat surfaces 34 and 50 on the cage and shoe respectively, to increase frictional resistance to movement of the thread (see FIG. 5). At other times than during upward acceleration or downward deceleration of the needle bar, the thread can move freely through the snubbing device 26 (see FIG. 4).

In FIG. 6, there is shown a solid line curve which indicates the position of the needle 24 during its reciprocation through various crank angles of the crank 14. The crank angle marked zero degrees corresponds to the bottom dead center of needle reciprocation. In the solid line curve showing needle reciprocation, a heavy line indicates that portion throughout which inertia causes the shoe to move downwardly in the cage 28 of the snubbing device 26 such that it is cammed in the direction of the needle clamp 17. A portion shown in light lines is that in which the inertia of the shoe causes it to move upwardly, and pressure by the shoe on the thread T to be released. Shown in dot and dash lines in FIG. 6, is a thread curve indicating the thread which is made available by operation of the stitch forming instrumentalities during stitch formation. In such curve, a slope downwardly to the right indicates a slacking in the thread by take-up lever 16, and a slope of the curve upwardly to the right indicates a drawing action of the take-up lever on the thread. The heavy lines in the Figure depict the downward movement of the thread toward the needle through snubbing device 26, and light lines indicate upward movement of the thread through the snubbing device. Points of loop seizure and of stitch setting for a typical cycle of stitch formation are indicated in FIG. 6, and it may be noted that during loop seizure the combined effect of the inertia and of the downward direction of thread travel is such as to influence the shoe into a thread snubbing position, that is into a position in which pressure is applied to the thread between the shoe and needle clamp; whereas during stitch setting the effect of inertia and the direction of thread travel in the snubbing device is such as to influence the shoe out of a pressure applying position against the thread.

Referring to FIGS. 7, 8 and 9, there may be seen an alternate form of snubbing device 60 according to the invention including a cage 62 and shoe 64. The cage includes a bracket like portion 65 which attaches to the side of a needle clamp 66 with a screw 68, and a frame-like portion 70 with a window 72. The shoe 64 is essentially a plate with an angled marginal edge portion 74. The shoe is loosely confined by frame-like portion 70 of the cage opposite a flat surface 76 on the needle clamp and with the angled portion 74 of the shoe in the window 72 of the cage where it engages the bottom edge 78 of the window. The shoe includes thread guiding rounded end portions 79 and 80 at the left side (as viewed in FIG. 7). Snubbing device 60 is threaded from the left side merely by introducing thread around the thread guiding end portions 79 and 80 of the shoe 64 and through a side thread accessible opening 81 in the cage 20 into a position between a flat surface 82 on the rear of the shoe and flat surface 76 on the needle clamp. The inertial mass of the shoe causes it to move downwardly in the cage during upward acceleration and downward deceleration of the needle bar. As the shoe moves downwardly in the cage, engagement of the angled portion 74 of the shoe with the bottom edge 78 of window 72 causes the shoe to be moved toward the needle clamp and thread to be pressed between flat surfaces 76 and 82 (see FIG. 9). With a cycle of stitch formation as shown, for example, in FIG. 6, thread is snubbed during loop seizure because of the inertia of the shoe and direction of movement of thread through the snubbing device, however, the thread is released (see FIG. 8) during stitch setting by reason of the inertia of the shoe and the direction of thread travel in the snubbing device at such time.

In each of the forms of the invention line contact rather than point contact between the thread engageable parts of a snubber and the thread running through it results when thread is snubbed. There is therefore, a distribution of the snubbing force along a length of thread and thread can move through the snubbers to satisfy the demands of a loop taker without being pinched and subjected to undue tension. To further provide for the smooth flow of snubbed thread through the snubbers in response to loop taker demand, the mass of the shoe and angle along which the shoe and cage engage in the snubbers are selected to provide for only the application of slight pressure to the thread being snubbed.

It is to be understood that the present disclosure relates to preferred embodiments of the invention which are for purposes of illustration only and are not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. A thread snubbing device for a lockstitch sewing machine including a reciprocable needle bar with a needle clamp thereon, said device comprising a shoe of predetermined mass and a cage which loosely holds the shoe next to the needle clamp, the shoe and needle clamp including flat opposing surfaces, the cage having a side thread accessible opening and the shoe having a thread guiding end around which the thread may be led into a position between the opposing surfaces on the shoe and clamp, the shoe and cage being engagable along a sloping surface and the shoe being movable thereby toward the needle clamp to effect the snubbing of the thread between said opposing flat surfaces during upward acceleration or downward deceleration of the needle bar.

2. The combination of claim 1 wherein the sloping surface is on the shoe.

3. The combination of claim 1 wherein the cage is ribbed and the shoe engages a rib of the cage along the sloping surface.

4. The combination of claim 3 wherein the sloping surface is on the shoe.

5. The combination of claim 1 wherein the cage is ribbed, the shoe includes a plurality of parallel lands, the lands are between ribs of the cage, and the sloping surface along which the shoe and cage are engagable is on the underside of one of the lands.

6. The combination of claim 1 wherein the cage has an open window, the shoe includes an angled portion which defines said sloping surface and said shoe is disposed with such angled bottom portion in contact with the cage at an edge of the window.

7. The combination of claim 6 wherein the angled portion of the shoe is a bottom upturned edge portion and the shoe is disposed with such bottom upturned edge portion in contact with the bottom edge of the window.

* * * * *